US005834054A

United States Patent [19]

Berry

[11] Patent Number: 5,834,054

[45] Date of Patent: Nov. 10, 1998

[54] METHOD FOR RESTORING AN AUTOMOTIVE PAINT FINISH

[76] Inventor: Bradford E. Berry, 2070 S. Monaco Pkwy., Denver, Colo. 80224

[21] Appl. No.: 924,916

[22] Filed: Sep. 8, 1997

[51] Int. Cl.[6] ..... B05D 3/00

[52] U.S. Cl. ..... 427/142; 427/211; 427/217; 427/388.1

[58] Field of Search ..... 427/142, 388.1, 427/358, 271, 287, 355

[56] References Cited

U.S. PATENT DOCUMENTS 5,077,086 12/1991 Cavill ..... 427/142
5,082,692 1/1992 Cavill ..... 427/142

*Primary Examiner*—Janyce Bell

*Attorney, Agent, or Firm*—Charles C. Corbin

[57] ABSTRACT

A method and system for repairing and restoring chipped and scratched regions of an automotive body, the damage being characterized by recesses in the exterior, involves the use of color-matched paint repair material, and includes the steps of cleaning the recesses, coating the recesses and adjacent area with a lubricating agent that also will retard the ability of the repair material to bond with surfaces of the damaged region. The paint-repair material is deposited on undamaged surfaces adjacent the recesses, and then a blade comprised of a soft resilient plastic material is slidably moved over the damaged region to spread and move the deposited paint over the damaged region causing the paint-material to be deposited in the recesses and to remove most of the excess material from the undamaged surfaces adjacent to the recesses. After a short drying interval, final steps include wiping away excess repair material soft cloth wetted with a suitable solvent.

17 Claims, No Drawings

METHOD FOR RESTORING AN AUTOMOTIVE PAINT FINISH

BACKGROUND OF THE INVENTION

1. Field of the Invention

The present invention relates generally to methods for restoring an automotive exterior paint finish that has been chipped or scratched.

2. Description of the Prior Art

The exterior paint finish of an automobile may become chipped or scratched during normal use due to impact by flying rocks and pebbles, or by vandalism. Complete restoration and repainting of the entire affected area is usually not warranted because of the cost and time involved, particularly when the paint finish is otherwise unblemished, and as a result methods have been sought and developed for "touching up" the individual blemishes in the damaged areas with paint the matches the color of the original finish.

The earliest approach to the problem was to simply use a small paint brush to apply a quantity of color-matched touch-up paint to the recesses of the damaged area. Another early approach involved using a syringe for direct application of touch-up paint to the damage recesses. Unfortunately these techniques often resulted in touched up areas that were lumpy and uneven, and did not blend well with the original paint surface.

Subsequently, in an attempt to improve the quality of paint finish restorations, techniques were developed that were based on use of the airbrush and are currently the most popular approaches. Such airbrush based methods typically involve the cleaning the recesses and adjoining area with a suitable liquid solvent/cleaner, such as a wax/silicone remover and or a degreaser and then applying color-matched paint to the damaged area, including recesses, by an airbrush. The touch up paint is then allowed to dry. Unfortunately all airbrush based techniques cause paint to be sprayed on undamaged surfaces adjacent to the recesses, and this excess material must be removed. Thus the repair area is wiped with a towel wetted with a paint remover, and great care is required to ensure that primarily the excess paint is removed, and to avoid removing the paint deposited in the recesses. Unfortunately, particularly with wider recesses, it is almost unavoidable not to disturb the paint in the recesses. It is the downward rubbing pressure of the towel and/or strong removal solvents in the towel that will cause this undesirable disturbance of the paint in the recesses, and often the strong solvents will cause the color of the popular high metallic touch-up paints to be badly distorted.

Another shortcoming of airbrush based methods is that the airbrush does not lend itself to dispensing the denser, high solids content paints. Such paints are desirable and contribute to a more efficient application since it is the solids that actually fill the recesses after the solvents evaporate. Furthermore, regarding airbrush based techniques, it is often the recommended practice to spray only one or two recesses at a time, which adds to the overall time of the restoration process. Yet another drawback of airbrush based techniques is the need for a compressed air source such as an electrically powered air pump, and hoses and associated equipment.

U.S. Pat. Nos. 5,520,955 and 5,077,086 to Cavill attempt to address some of the problems associated with airbrush techniques by providing an improved paint solvent composition for removing the paint overspray from bordering surfaces. The approach shown in U.S. Pat. No. 4,814,200 (Propst) for removing paint overspray is essentially that of wiping the freshly sprayed paint with a towel saturated with a liquid wax preparation, and then wiping the waxed area with an absorbent towel to remove the overspray and wax.

Despite the apparent advances in the art of blemish repair, there remains the need for improvements.

SUMMARY OF THE INVENTION

In view of the aforestated shortcomings and limitations of the prior art it is a general object of the present invention to provide an improved method for repairing a chipped or scratched exterior paint surface of an automobile.

A more particular object is to provide a repair method that does not require the use of electric power or a compressed air source, and associated equipment such as hoses.

Another object is to provide a restoration method that is quick, yet highly effective, and involves a few simple steps.

A further object is to provide such a method that is highly efficient and economical with respect to its ability to restore many recesses at one time.

Yet another object is to provide a method by that lends itself to application of the more dense, high solids content touch-up paints, which ordinarily cannot be handled by airbrush techniques without substantially thinning the paints.

A still further object is to provide a restoration method that, during the application step, will leave very little paint on the bordering surfaces, thereby leaving very little paint to be removed in a subsequent step.

Yet a further object is to provide a restoration method that can handle relatively large recesses while not disturbing the paint deposit in the recesses.

Accordingly the foregoing and other objects and advantages are provided by the present invention of a method for restoring a damaged automotive paint exterior, the damage characterized by recesses in the paint exterior, the method including the first step of cleaning the recesses and bordering surfaces. Then a bead of touch-up paint, color-matched with the original finish, is deposited on the bordering surfaces. While the deposit is still wet, the bordering surfaces and the wet deposit are engaged with an edge portion of a soft, resilient blade of polymeric material, and the blade is slidably moved over the damaged region so as to cause the recesses to be filled with the wet paint, and to sweep and remove the wet paint from the bordering surfaces while leaving the recesses substantially filled with the touch-up paint. After a short paint-drying period of preferably about two minutes, and no more than fifteen minutes, a soft flexible absorbent material, wetted with a suitable paint solvent is gently wiped over the damage area to remove any touch-up paint that may remain on the bordering surfaces.

In a preferred embodiment of the invention the wet paint application step is preceeded by the step of coating the recesses and bordering surfaces with a lubricating agent, preferably a liquid, that also has the capability of retarding the bonding of the selected touch-up paint to the recesses and bordering surfaces and which agent lubricates the movement of the application blade.

This comprises the essence of the invention, and final steps may include gently wiping the restored area with a soft cloth wetted with a solution suitable for removing from the bordering area any residue mixture of solvent and touch-up paint.

Preferably the paint-spreading and removing tool is a piece of ⅛ inch thick polyurethane material having a straight edge, and the preferred touch-up paint is a high-solids urethane paint that allows about a two minute drying time.

DETAILED DESCRIPTION OF THE INVENTION

The method of the present invention will be described by way of the following illustrative example in which it is used to restore an area of the original painted surface of an automobile that has been blemished with several small recesses or cavities caused by impact by flying pebbles or rocks, and it will be seen that the method is particularly advantageous for economically repairing, at one time, fairly large numbers of recesses, for example 30 to 50 in a typical repair job, or even more. Typically most of these recesses or dinks are irregular, roughly circular cavities having a depth that extends substantially through the layers of the original paint, almost to the bare metal substrate.

First the entire damaged area, including the recesses, are cleaned with a soft cloth containing a conventional cleanser designed for removing grease, silicone and wax, such as is commercially available under the trademark PERMAHYD. Thus all substances that would potentially prevent satisfactory bonding of the touch-up paint to the recesses are removed.

Next a squeeze or a spray bottle containing a liquid lubricant is used to deposit a bead or stream of the lubricant on surfaces bordering the recesses. A preferred lubricant is a plant-derived oil, preferably linseed oil. Mineral oil or other light hydrocarbon oil may also be used. The lubricant will also act to retard the time taken for the preferred touch-up paint, to be described, to bond to the damaged area, but not to completely eliminate this bonding capability. It is to be understood that under the invention there are contemplated other suitable liquid and/or powdered lubricants that will have similar properties. A soft cloth is then used to spread the lubricant over the recesses and bordering surfaces.

Next a quantity of color-matched touch-up paint, preferably a fast-drying, high-solids content polyurethane paint, such as is available under the trademark GLASURIT is applied from a squeeze bottle in the form of a bead to surfaces bordering the recesses. Then a rectangular blade of a soft resilient polyurethane material, preferably about 3 inches by 5 inches by ⅛ inch, is used to move the wet paint deposit into the recesses and to remove excess wet paint from the bordering surfaces. Preferably the blade has a softness of about 60 to 85 durometers. A straight edge portion of the blade is maintained in contact with the bordering surfaces as it is moved by hand to push the wet paint into and fill the recesses and to swipe excess paint off the bordering surfaces, and the lubricant ensures that this blade movement will be accomplished smoothly, easily and quickly with no danger of scratching the bordering surfaces. It should also be evident that paint application in this manner will allow a fairly large number of recesses, 30 to 50 for example in a typical single application, to be filled simultaneously. Following this paint application and excess removal step there will be virtually no excess paint or very little on the bordering surfaces. This dearth of excess material will enhance the efficacy of the latter step for removal of excess touch-up paint, making that step easier, quicker and highly effective.

Next the touch-up paint is allowed to dry, and this will take preferably about 2 minutes and no longer than 15 minutes,. Then the damaged area is wiped gently, with a minimum of downward pressure, with a soft cloth wetted with a paint solvent that is strong enough to remove the excess paint but not so strong as to remove the paint in the recesses. A suitable paint solvent is a mixture comprising a quantity of paint thinner such as available under the mark 5-STAR 5700 diluted with about an equal quantity of mineral spirits. For smoother, easier wiping, a lubricant comprising a conventional low-viscosity mineral oil of about half to equal the volume of the solvent mixture is preferably added to the solvent mixture. The very small amount of overpaint that the present method leaves permits this mixture to be quite effective, and its diluted strength also ensures that the paint in the recesses will not be tarnished. For the reasons mentioned above a very minimal amount of wiping is required, and this greatly decreases the chances of disturbing the paint deposited in the recesses. Finally, in order to remove any residue of mixture of touch-up paint and solvent, the restored area is gently wiped with a soft cloth wetted with mineral spirits. Optionally, if desired, the restored surface may then be coated with a non-wax, polymer glaze, and then buffed dry.

Although there has been described a particular embodiment of the invention with reference made to certain particular paint compositions, solvents and removers, and application tools for example, it will be obvious to those skilled in the art that various changes and modifications may be made therein without departing from the invention. Therefore it is aimed to cover all such changes and modifications as fall within the true scope and breath of the invention as defined in the claims which follow.

What is claimed is:

1. A method for repairing and restoring a damaged surface region of the exterior paint finish of an automobile wherein the damaged region is characterized by recesses in said surface region, said method including the steps of:

a) cleaning said recesses;

b) applying a deposit of wet color-matched touch-up paint to a bordering surface of said recesses;

c) while said deposit is still wet, engaging said bordering surface and said wet deposit with an edge portion of a soft, resilient blade and slidably moving said blade over said damaged region so as to cause said recesses to be filled with said wet paint, and to sweep and remove said wet paint from said bordering surfaces while leaving the recesses filled with said paint; and d) allowing said paint to dry.

2. A method as defined in claim 1 including, prior to said step of applying said wet paint, coating said damaged surface with a lubricating agent for lubricating said sliding movement of said blade.

3. A method as defined in claim 2 wherein said lubricant is effective for retarding the ability of said paint to bond with said damaged surface region.

4. A method as defined in claim 2 wherein said paint is allowed less than 15 minutes to dry, followed by the step of gently wiping said damaged region with a soft flexible absorbent material wetted with a solvent for said dry touch-up paint, so as to remove any of said touch-up paint on said bordering surfaces.

5. A method as defined in claim 2 wherein said paint is a high-solids content paint.

6. A method as defined in claim 5 wherein said paint is a urethane based paint.

7. A method as defined in claim 2 wherein said lubricating agent is a light-weight oil.

8. A method as defined in claim 7 wherein said lubricating agent is a plant-based oil.

9. A method as defined in claim 7 wherein said lubricating agent is linseed oil.

10. A method as defined in claim 7 wherein said lubricating agent is a hydrocarbon oil.

11. A method as defined in claim 10 wherein said lubricating agent is mineral oil.

12. A method as defined in claim 2 wherein said lubricating agent is a polymer emulsion.

13. A method as defined in claim 2 wherein said drying time is about 2 minutes.

14. A method as defined in claim 1 wherein said paint is allowed less than 15 minutes to dry, followed by the step of gently wiping said damaged region with a soft flexible absorbent material wetted with a solvent for said dry touch-up paint, so as to remove any of said touch-up paint on said bordering surfaces.

15. A method as defined in claim 1 wherein said paint is a high-solids content paint.

16. A method as defined in claim 15 wherein said paint is a urethane based paint.

17. A method as defined in claim 1 wherein said blade is comprised of a polyurethane material.

* * * * *